United States Patent [19]

Dassler et al.

[11] Patent Number: 4,837,477

[45] Date of Patent: Jun. 6, 1989

[54] HIGH PRESSURE DISCHARGE LAMP WITH IMPROVED ARC TUBE RETENTION STRUCTURE

[75] Inventors: Joachim Dassler; Detlef Girod; Klaus Kramer; Ingrid Liesch, all of Berlin, Fed. Rep. of Germany

[73] Assignee: Patent Treuhand Gesellschaft fur elektrische Gluhlampen mbH, Munich, Fed. Rep. of Germany

[21] Appl. No.: 152,914

[22] Filed: Feb. 5, 1988

[30] Foreign Application Priority Data

Feb. 20, 1987 [DE] Fed. Rep. of Germany ... 8702658[U]

[51] Int. Cl.[4] ..... H01J 61/34

[52] U.S. Cl. ..... 313/25; 313/631

[58] Field of Search ..... 313/25, 631, 26, 27

[56] References Cited

U.S. PATENT DOCUMENTS 3,662,203 5/1972 Kuhl et al. ..... 313/25

4,401,913 8/1983 Koza et al. ..... 313/25

4,737,667 4/1988 Whitten ..... 313/25

FOREIGN PATENT DOCUMENTS 48-24367 7/1973 Japan .

*Primary Examiner*—Kenneth Wieder

*Attorney, Agent, or Firm*—Frishauf, Holtz, Goodman & Woodward

[57] ABSTRACT

To retain an arc tube (6, 16) in precise position with respect to an optical system (R) within an outer envelope (2, 12), the arc tube is retained at both ends by spiral springs (23) which have a cylindrical portion fitted in a sleeve-like current supply (7, 17) to the arc tube and having a conically expanding portion (25), terminating in an end portion (26) which is welded to a central guide pin (27) fitted and movable within the cylindrical portion (24) of the spring. The guide pin (27) can form part of an internal current supply (FIG. 3: 19) or be secured to an internal current supply lead (FIGS. 1, 2: 9).

22 Claims, 4 Drawing Sheets

HIGH PRESSURE DISCHARGE LAMP WITH IMPROVED ARC TUBE RETENTION STRUCTURE

REFERENCE TO RELATED DISCLOSURES

U.S. Pat. No. 4,401,913, Koza et al (to which European published patent application No. 0066783 corresponds).

Japanese Utility Model No. 48-24367 published 16 July 1973.

The present invention relates to a high pressure discharge lamp and more particularly to a high pressure discharge lamp in which an arc tube is retained in a holding structure, for example, an outer bulb.

BACKGROUND

U.S. Pat. No. 4,401,913, to which European published patent application No. 0066783 corresponds, describes a high pressure discharge lamp having an outer bulb having a dome-shaped cap at one end and a screw-in base at the other. The discharge vessel itself is retained in the longitudinal axis of the lamp. The end of the discharge vessel coupled to the end of the bulb which has the screw thread for a base attached thereto is retained by a rigid terminal wire in the bulb. The end of the discharge tube remote from the base is retained in the bulb by a spring element which is held in position by the bulb itself. To hold the spring element in centered location, the bulb is formed with an inwardly extending closed sleeve portion about which the spring, in form of a spiral spring, is wrapped. The spring is provided to permit acceptance of longitudinal tolerances of the discharge vessel, and, also, to compensate for thermal expansion of the discharge vessel, in operation.

Japanese Utility Model No. 48 24637 describes a spiral holding wire to compensate temperature losses. One end of the spiral holding wire is wrapped about the exhaust tube of the discharge vessel, the other end being secured to a rigid holding wire for the discharge vessel. The holding wire is provided to compensate for thermal expansion of the discharge vessel and, simultaneously, to heat the exhaust tube during operation of the lamp.

It has been found that the holding arrangements for discharge vessels within an outer bulb or envelope surrounding the discharge vessel should be improved to retain centricity of the discharge vessel in operation.

THE INVENTION

It is an object to provide a holding arrangement for a discharge vessel within an outer bulb which provides precise centering of the discharge vessel while retaining it in position without transfer of forces to a connection melt closure of the outer bulb.

Briefly, an electrical connection element, such as a wire element extends from the respective ends of the outer bulb, in opposite directions towards the discharge vessel. At least one of the electrical connection elements includes a spring element which is positioned between the arc tube and an adjacent end connection of the envelope. The spring, preferably, is so constructed that it is oriented to permit resilient axial excursion of the arc tube while resiliently, elastically resisting radial excursions thereof.

The arrangement has the advantage that the resilient element can be directly connected, for example, by a weld connection to the lead-in passing through the outer envelope and, by extending the lead-in, permitting the lead-in to form a centering element for the spring.

DETAILED DESCRIPTION

Figure 1:
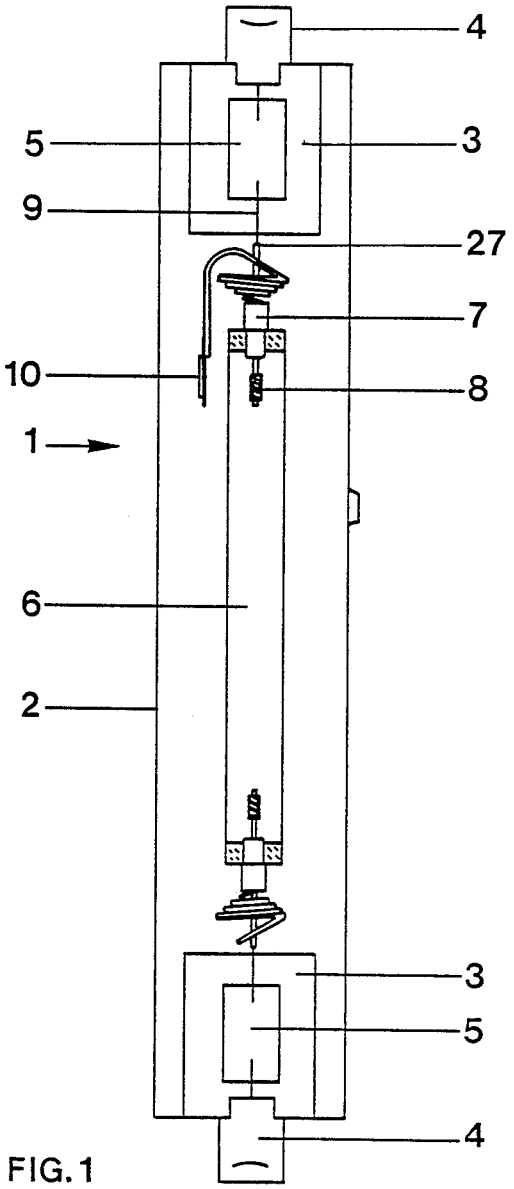
FIG. 1 is a schematic side view of a sodium high-pressure discharge lamp incorporating the present invention.
Figure 2:
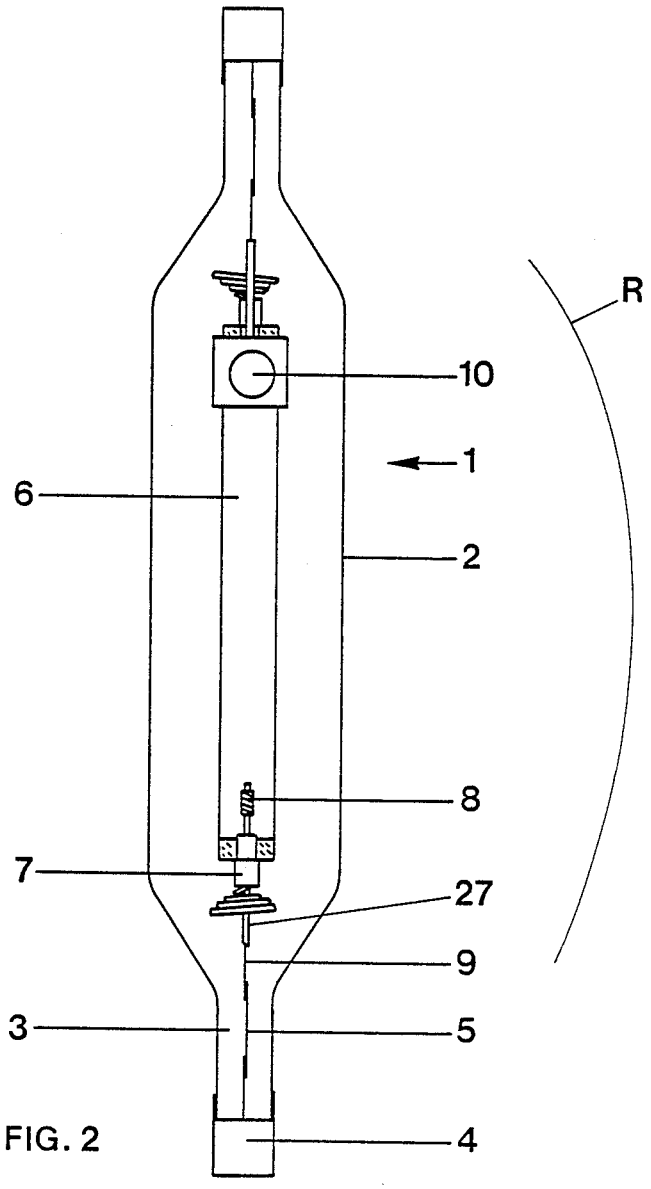
FIG. 2 is a side view similar to FIG. 1, but rotated 90° about the vertical axis of the lamp.

The high pressure discharge lamp of FIGS. 1 and 2 is designed for placement in a two-element socket. The lamp, typically, is a 70W lamp which has a tubular outer envelope 2 of quartz, sealed at the respective ends by pressed seals 3. The base 4 has the IES designation R7s. The pressed seals 3, retain a molybdenum sealing foil 5.

A tubular discharge vessel 6 of aluminum oxide ceramic is coaxially retained within the outer envelope or bulb 2. The discharge vessel 6 has a gas-tight melt at each end through which a current supply lead 7 of niobium is passed. The current supply 7 is tubular and is connected to an electrode 8 made of tungsten.

Figure 4:
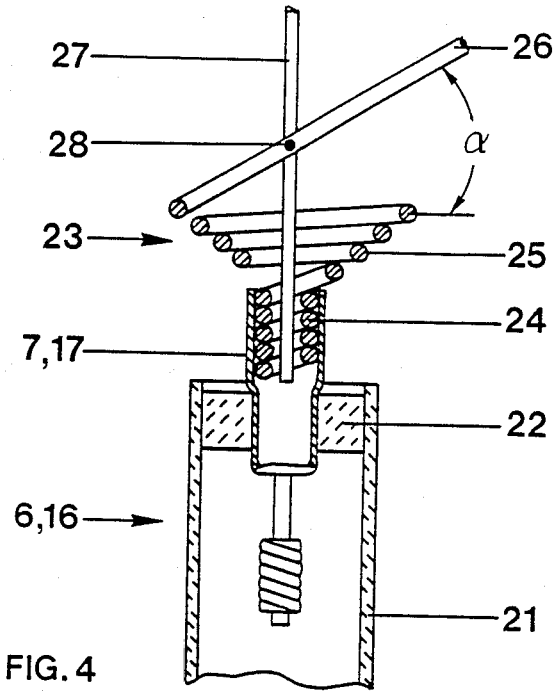
FIG. 4 is an enlarged fragmentary view illustrating the holding arrangement for the arc tube.
Figure 5:
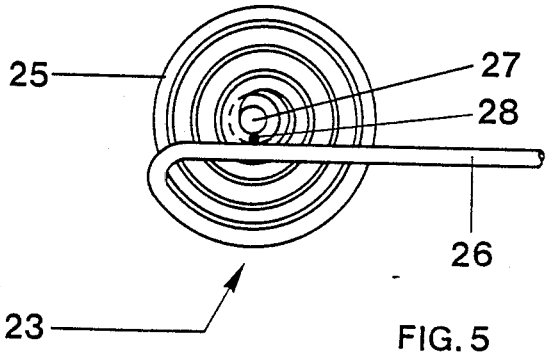
FIG. 5 is a top view of the holding arrangement of FIG. 4.

The holding structure of the discharge vessel 6, in precisely centered position, i.e. in the lamp axis, within the outer bulb or envelope 2 is shown in detail in FIGS. 4 and 5. It extends between the current supply 7 of the discharge vessel 6 and the inner current supply lead or pin element 9, which is connected to the molybdenum sealing foil 5. The space between the bulb or outer envelope 2 and the discharge vessel 6 is evacuated. A getter plate 10 is secured in the space, and coupled to a holding portion of the centering and holding structure for the discharge vessel 6.

Figure 3:
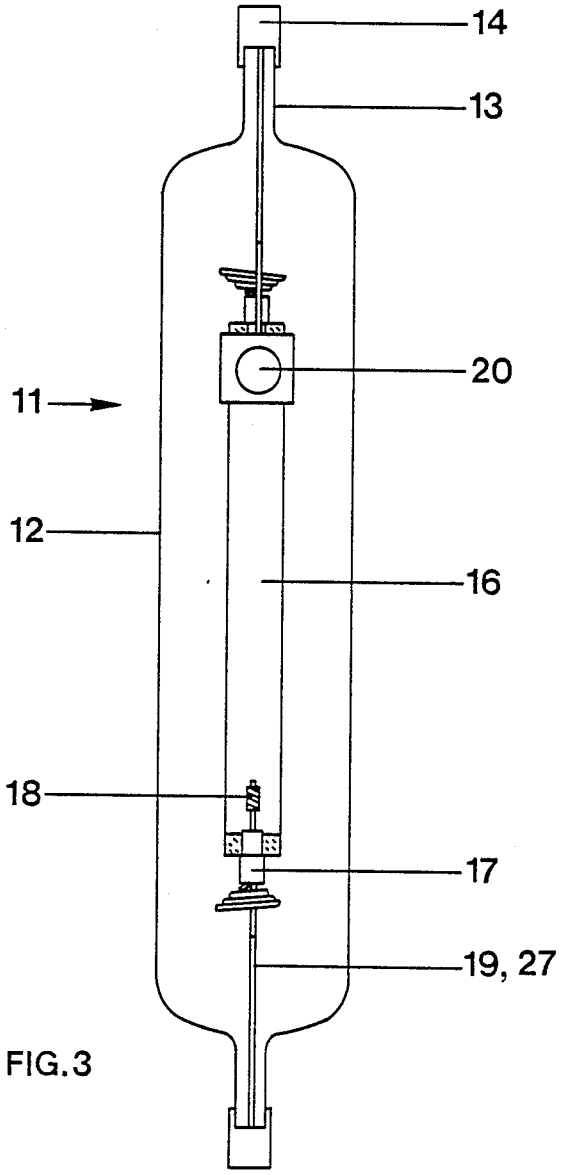
FIG. 3 is a view similar to FIG. 2 and illustrating a different embodiment of a lamp.

FIG. 3 illustrates another type of high-pressure discharge lamp 11 of 70W rating. The outer envelope or bulb 12 is made of hard glass, so that the sealing foils of molybdenum within the pinch seal 13 can be eliminated. The inner current supply 19 is directly connected to a base 14 of the type R7s and inwardly extends into the space between the envelope 12 and the discharge tube 16 which, again, is evacuated. The discharge vessel 16 itself is made of aluminum oxide ceramic, and for example may be identical to the structure shown in FIGS. 1 and 2, and retained within the outer envelope 12 in the same way, to be described in detail with reference to FIGS. 4 and 5. The current supply 17, in tubular or sleeve form and made of niobium, as well as the electrode 18 within the discharge vessel 16 are similar to, and can be identical to the structure shown in connection with FIGS. 1 and 2. A getter 20, to maintain the vacuum between the discharge vessel 16 and the inner walls of the envelope 12, is held in position by the upper elastic connection between the current supply lead 19 and the tubular niobium current supply 17. The electrode 18 is made of tungsten.

FIGS. 4 and 5 show the arrangement to hold the discharge vessel 6, 16, respectively, in detail. The discharge vessel 6 or 16 includes a tubular body 21 of aluminum oxide ceramic, closed off at the respective ends by a perforated plug 22, also of aluminum oxide ceramic and, for example, centered to the tubular body 21. The tubular current supply 7, 17 of niobium is secured through a central opening in the respective plug 22 by a suitable melt glass to form a gas-tight connection. The current supply 7, 17 is closed at the side facing the interior of the arc tube. The respective electrode 8, 18 is connected to a dome-shaped end closure of the tubular current supply element 7, 17. The tubular current supply 7, 17 thus forms a hollow, closed sleeve within which the resilient holding spring 23 is retained with an end portion thereof, and held in the sleeve, for example by a resistance welding connection to the sleeve.

In accordance with a feature of the invention, the resilient element includes a spiral spring 23 made of a shaped, spirally wound, half-hardened nickel wire, for example, of "Duratherm" (reg. TM). This is a material which forms a hardenable spring alloy, based on a cobalt-nickel-chromium composition. Alternatively, the spring element 23 may be made of highly heat resistant spring steel wire of, for example, about 0.6 mm diameter. Preferably, the spring element 23 is wound to provide four tightly adjacent loops or winding wraps which form an essentially cylindrical portion 24, to which four more loops 25 are joined, of respectively increasing diameter, roughly similar to a wire whisk. The end 26 of the spring, at the maximum diameter, is angled off to extend transversely across the axis of the spring, and at an angle $\alpha$ of about 30°. The end portion 26 does not pass through the center of the axis but, rather, at a tangent thereto, to permit lateral welding, for example, by a resistance weld as shown in 28 to the guide Pin 27, corresponding to the lead 19 (FIG. 3) or 9 (FIGS. 1, 2). The getter 10, 20 (FIGS. 1, 3}is secured to the terminal end portion of the projecting end 26 of the spring element 23. Spring 23 does not touch or come in contact with the outer envelope 2, or 12.

The cylindrical part 24 of the spring element 23 is so designed that it essentially fits against the inner diameter of the tubular current supply element 7, 17, even if the tubular current supply element 7, 17 changes in interior diameter, or is already made in different interior diametrical sizes. This is readily possible by wrapping the cylindrical portion 24 with closely adjacent stacked windings. The wound portion 25, which has an increasing diameter permits acceptance of longitudinal expansion, by the general conical form of the spring element. The respective windings or loops are so designed that they can overlap in case of jolts or axial excursion of the arc tube 6, 16 with respect to the adjacent base or socket structure of the lamp. Thus, the cone should have a cone angle wide enough that vertically adjacent loops of the windings can fit into the next adjacent ones—with reference to FIG. 4, for example, and as seen in FIG. 5.

The end portion 26 of the spring element 23 is located tangentially to the longitudinal axis of the lamp, which is also tangentially to the longitudinal axis of the spring element 23 as such. It is coupled by a resistance weld 28 with a guide pin 27. The end of the guide pin 27 facing the discharge vessel 6, 16 extends within the cylindrical portion 24 of the spiral spring 23, and is axially freely movable therein. The inner diameter of the cylindrical portion 24 is so dimensioned with respect to the diameter of the guide pin 27 that, even under maximum thermal expansion, free movement of the pin 27 within the cylindrical portion 24 is possible The shape of the outer bulb and the construction of the outer bulb can be made, as desired, of quartz glass or hard glass. In dependence on the respective embodiments of the outer envelope, the guide pin 27 and the inner current supply elements 9 and 19 will be different, since the melt connection through the outer bulb will be different.

In the high-pressure discharge lamp shown in FIGS. 1 and 2, in which the outer envelope 2 is of quartz glass, the guide pin 27 is made of molybdenum and welded to the inner current supply 9. The inner current supply 9 is then coupled to the sealing foil 5 within the pinch seal 3—see, for example, FIG. 2. In the embodiment of FIG. 3, the guide pin 27 is made of tungsten and, simultaneously, forms the inner current supply lead 19. To seal the tungsten lead 19 through the pinch seal 13 of the envelope 12 of hard glass, a transition glass is preferably placed on the portion of the lead 19 before forming the pinch seal, in accordance with well-known lamp-tungsten lead technology.

The spiral spring, one at each end of the discharge lamp, and particularly when formed with a cylindrical portion fitting into the connection tube 7, 17 and the subsequent conical portion provides for locating the arc tube in a precisely defined position e.g. a central axis of the lamp or with respect to an optical system, shown only schematically, and in fragmentary form, as a reflector R. The spring element 23, and particularly the conical portion 25 in which the spring loops have increasing diameter can accept longitudinal expansion of the discharge lamp vessel which is made of quartz glass. In metal halide high-pressure discharge lamps, different thermal coefficients of expansion can thus be readily accommodated. The thermal coefficient of expansion for quartz glass is $5.4\times10^{-7}$ mm/°C. mm. The thermal coefficient of expansion for aluminum oxide ceramic is $80\times10^{-7}$ mm/°C. mm. These widely different coefficients of expansion can readily be compensated by the spring elements 23. Using two spring elements, one at each end of the lamp has the additional substantial advantage that the discharge vessel 6, 16 can be held in position essentially free from vibration, or damage, which is transferred thereto by vibration, shocks, and the like. Retaining only one end in fixed position transfers shocks from an external socket to the base of the lamp and hence also to the discharge vessel which, if it is free to move at the other end, may then subject the fixed lead-in to bending forces. In a preferred embodiment, both ends of the discharge vessel 6, 16 are held in position by respective spring elements 23 and precisely centered and guided by the pins 27 which extend into the axial portion 24 of the spring element 23. It is possible, however, to retain only one end of such lamps with a spring element 23, as described, although centered retention of the lamp and maximum resistance to socket vibration is not thereby insured.

The structure of the present invention has substantially advantages with respect to heat conduction over prior art structures. Discharge vessels which have a fixed "cold spot" require precisely defined heat radiation from the discharge vessel towards the outside. This mandates free retention of the discharge vessel within the outer envelope and the structure in which any spring element between the discharge vessel and the outer envelope does not touch the outer envelope.

In accordance with a preferred feature, the angle $\alpha$ of the end portion 26 of the spring 23 is greater than the pitch angle or spiral angle of the conically expanding spiral windings 25 of the spring 23. This has the advantage that axial excursion of the arc tube, for example under shock or vibration, is essentially absorbed by the spiral portion rather than at the bend between the end portion 26 and the conically expanding spiral portion 25.

Various changes and modifications may be made within the scope of the inventive concept.

We claim:

1. A high-pressure discharge lamp, said lamp defining a central axis, and having an outer envelope (2, 12);

an arc tube or discharge vessel (6, 16) having two ends, gas tightly surrounded by said envelope, with an evacuated space between the outside of said arc tube and said envelope;

first electrical connection means (9, 19) extending inwardly of the outer envelope from respective ends in opposite direction said first electrical connection means defining a predetermined position for the arc tube or discharged vessel with respect to the central axis in the envelope;

second electrical connection means located at opposite ends of the arc tube or discharge vessel (6, 16); and at least one resilient combined connection and holding means (23) coupled to at least one of said first electrical connection means (9, 19) and to one of said second electrical connection means (7, 17) at a respective end of the arc tube or discharge vessel, and resiliently holding said arc tube or discharge vessel within the envelope, said at least one of said combined connection and holding means including a spiral spring means (23) electrically and mechanically secured to at least one of the first electrical connection means (9, 19) of the arc tube and at least one of the second electrical connection means (7, 17) at an adjacent end portion of the envelope, and oriented to permit resilient axial excursion while elastically resiliently resisting radial excursion with respect to said axis; and wherein said spring means is free from contact with the outer envelope (2, 12).

2. The lamp of claim 1, wherein said second electrical connection means includes a first portion located adjacent said arc tube;

and said first portion of the connection means is melted gas-tightly into an adjacent end portion of said arc tube.

3. The lamp of claim 1, wherein said spring means (23) comprises a spring element oriented to permit resilient axial excursion while elastically resiliently resisting radial excursion with respect to said axis.

4. The lamp of claim 1, wherein said spring means (23) comprises a spirally wound spring element having a cylindrical portion (24) and a conical portion (25), in which the conical portion has spiral winding loops of increasing diameter.

5. A high-pressure discharge lamp, said lamp defining a central axis, and having an arc tube or discharge vessel (6, 16) having two evacuated space between the outside of said arc tube and said envelope;

first electrical connection means (9, 19) extending inwardly of the outer envelope from respective ends in opposite direction said first electrical connection means defining a predetermined position for the arc tube or discharged vessel with respect to the central axis in the envelope;

second electrical connection means located at opposite ends of the arc tube or discharge vessel (6, 16); and at least one resilient combined connection and holding means (23) coupled to at least one of said first electrical connection means (9, 19) and to one of said second electrical connection means (7, 17) at a respective end of the arc tube or discharge vessel, and resiliently holding said arc tube or discharge vessel within the envelope, said at least one of said combined connection and holding means including a spiral spring means (23) electrically and mechanically secure to at least one of the first electrical connection means (9, 19) of the arc tube and at least one of the second electrical connection means (7, 17) at an adjacent end portion of the envelope, and oriented to permit resilient axial excursion while elastically resiliently resisting radial excursion with respect to said axis; and wherein said spring means is free from contact with the outer envelope (2, 12);

wherein said spring means (23) comprises a spirally wound spring element having a cylindrical portion (24) and a conical portion (25) in which the conical portion has spiral winding loops of increasing diameter;

wherein the second electrical connection means comprises a sleeve-like current supply element (7, 17) extending through at least one end portion of the arc tube (6, 16);

and wherein the cylindrical portion (24) of the spring means (23) is located within the interior of the tubular sleeve-like current supply element and fitted therein.

6. The lamp of claim 5, wherein the tubular sleeve-like current supply element (7, 17) surrounds and retains the cylindrical portion (24) of the spring means (23) for a distance sufficient to guide axial excursion of said arc tube while resisting radial excursion of the arc tube.

7. A high-pressure discharge lamp, said lamp defining a central axis, and having an outer envelope (2, 12);

an arc tube or discharge vessel (6, 16) having two ends, gas tightly surrounded by said envelope, with an evacuated space between the outside of said arc tube and said envelope;

first electrical connection means (9, 19) extending inwardly of the outer envelope from respective ends in opposite direction said first electrical connection means defining a predetermined position for the arc tube or discharged vessel with respect to the central axis in the envelope;

second electrical connection means located at opposite ends of the arc tube or discharge vessel (6, 16); and at least one resilient combined connection and holding means (23) coupled to at least one of said first electrical connection means (9, 19) and to one of said second electrical connection means (7, 17) at a respective end of the arc tube or discharge vessel, and resiliently holding said arc tube or discharge vessel within the envelope, said at least one of said combined connection and holding means including a spiral spring means (23) electrically and mechanically secured to at least one of the first electrical connection means (9, 19) of the arc tube and at least one of the second electrical connection means (7, 17) at an adjacent end portion of the envelope, and oriented to permit resilient axial excursion while elastically resiliently resisting radial excursion with respect to said axis; and wherein said spring means is free from contact with the outer envelope (2, 12);

wherein said spring means (23) comprises a spirally wound spring element having a cylindrical portion (24) and a conical portion (25), in which the conical portion has spiral winding loops of increasing diameter;

and wherein said first electrical connection means (9, 19) includes a guide pin (27) positioned within the cylindrical portion (24) of the spring means (23), freely movable along the longitudinal axis of the lamp within said cylindrical portion of the spring means.

8. The lamp of claim 7, wherein (FIGS. 1, 2) the envelope (2) comprises quartz glass;

and the first electrical connection means comprises at least one inwardly directed connection element (9) to which said guide pin (27) is secured.

9. The lamp of claim 7, wherein (FIG. 3) said first electrical connection means (19) is extended inwardly of the envelope (12) and forms, in part, said guide pin (27)

10. The lamp of claim 9, wherein said envelope (12) comprises hard glass, and said electrical connection means—guide pin (19, 27) forms a unitary element of an end portion of the envelope (12)

11. The lamp of claim 7 wherein said conical portion of increasing diameter terminates in an end portion (26) extending by a predetermined angle ($\alpha$) of inclination with respect to a longitudinal axis of the spiral spring element, tangentially to said axis and electrically and mechanically secured to one of said first electrical connection means (9, 19).

12. The lamp of claim 11, wherein said predetermined angle ($\alpha$) is greater than the pitch angle of the conical portion of the spiral spring element (23).

13. The lamp of claim 11, further including interior lamp component elements (10, 20) located in the space between the inner wall of the outer envelope (2, 12) and the outer wall of said arc tube, (6, 16) said component elements being secured to terminal portions of the end portion (26) of the spring element (23) adjacent the conical portion (25) thereof.

14. The lamp of claim 1, wherein two spring means (23) are provided, connecting the first and second electrical connection means at respective ends of the discharge vessel or arc tube (6, 16).

15. The lamp of claim 14, wherein each of said spring means (23) comprises a spring element oriented to permit resilient axial excursion while resiliently resisting radial excursion.

16. The lamp of claim 5 wherein two spring means (23) are provided, connecting the first and second electrical connection means at respective ends of the discharge vessel or arc tube (6, 16); and wherein each of said spring means comprises the spirally wound spring elements, the conical portion (25) of the spiral spring wire element being integral with the cylindrical portion thereof and having windings with progressively increasing diameter, in which the diameter of adjacent windings of the conical portion increases by at least the thickness of the wire of the spring wire element to permit, upon compression of the conical portion, overlap of adjacent windings.

17. The lamp of claim 7 wherein two spring means (23) are provided, connecting the first and second electrical connection means at respective ends of the discharge vessel or arc tube (6, 16);

each of said spring means comprises a spirally wound spring element having a cylindrical portion (24) and a conical portion (25), in which the conical portion has spiral winding loops of increasing diameter;

wherein each of said conical portions terminates in a respective end portion (26) extending at an angle with respect to the central axis of the lamp; and wherein said extending end portion of the spring element is tangentially secured to said guide element to retain the arc tube in longitudinal and axially predetermined position with respect to said outer envelope.

18. The lamp of claim 1, wherein said spring means (23) comprises a wound spiral spring wire element having a cylindrical portion (24) and an integral conical portion (25) having windings with progressively increasing diameter, in which the diameter of adjacent windings of the conical portion increases by at least the thickness of the wire of the spring wire element to permit, upon compression of the conical portion, overlap of adjacent windings.

19. The lamp of claim 18, wherein said conical portion (25) terminates in an end portion (26) extending at an angle with respect to the central axis of the lamp;

the respective first electrical connection means includes a pin element (27) extending centrally axially with respect to the cylindrical portion of the respective spring element and being freely movable axially with respect thereto; and wherein said extending end portion (26) is secured to said pin element (27) to retain the discharge vessel or arc tube in longitudinal, and axially predetermined position with respect to said outer envelope.

20. The lamp of claim 4, wherein said conical portion terminates in an end portion (26) extending at an angle with respect to the central axis of the lamp;

the first electrical connection means (9, 19) includes a pin element extending centrally axially within the wire spring element and being freely movable axially therein; and wherein said extending end portion (26) of the spring element is tangentially secured to said guide pin element to retain the arc tube or discharge vessel in longitudinally and axially predetermined position with respect to said outer envelope

21. The lamp of claim 5, wherein the arc tube or discharge vessel (6, 16) comprises a ceramic.

22. The lamp of claim 7, wherein the arc tube or discharge vessel (6, 16) comprises a ceramic.

* * * * *